United States Patent [19]

Ogata et al.

[11] 4,412,732

[45] Nov. 1, 1983

[54] TRANSFER MEDIUM SEPARATING DEVICE

[75] Inventors: Yoshihiro Ogata, Yokohama; Yoshihiro Abe, Tokyo; Harumi Takahashi, Yokohama, all of Japan

[73] Assignee: Ricoh Company, Ltd., Japan

[21] Appl. No.: 284,343

[22] Filed: Jul. 17, 1981

[30] Foreign Application Priority Data

Jul. 21, 1980 [JP] Japan ..... 55-98700
Jul. 21, 1980 [JP] Japan ..... 55-98701

[51] Int. Cl.[3] ..... G03G 15/00; G03G 15/14

[52] U.S. Cl. ..... 355/3 TR; 355/3 SH; 355/14 TR; 355/14 SH; 271/DIG. 2

[58] Field of Search ..... 355/3 TR, 3 R, 3 SH, 355/14 TR, 14 SH; 271/311, DIG. 2, 313, 307; 361/265

[56] References Cited

U.S. PATENT DOCUMENTS 3,851,230 11/1974 Okamoto et al. ..... 355/3 R X
4,055,380 10/1977 Borostyan ..... 355/3 TR
4,159,172 6/1979 Tani et al. ..... 355/3 TR
4,183,653 1/1980 Satomi et al. ..... 355/3 CH X
4,286,862 9/1981 Akita et al. ..... 355/3 SH
4,342,512 8/1982 Tolmie, Jr. ..... 355/3 SH X

FOREIGN PATENT DOCUMENTS 2459760 11/1975 Fed. Rep. of Germany ... 355/3 SH

*Primary Examiner*—Arthur C. Prescott
*Attorney, Agent, or Firm*—Guy W. Shoup; Eliot S. Gerber

[57] ABSTRACT

An improved copy paper separating device for use in a transfer type electrophotographic copying machine is provided. The separating device includes a conductive carrier member, preferably in the form of a conductive endless belt extended between a pair of pulleys. The conductive carrier member is disposed in the periphery of the photosensitive member to which a copy paper is brought into contact for the transfer of a toner image formed on the photosensitive member. The potential of the conductive carrier member is maintained nearly at zero level during the first step of the separating operation; whereas, the potential of the carrier member is increased to a predetermined value of the polarity opposite to that of the toner image during the second step. Information as to the conditions of separating operation is also supplied and the timing of changing potentials is appropriately adjusted. Moreover, a plurality of voltage sources having different potential levels are provided and the potential is selectively applied to the carrier member as required, which is particularly useful when applied to a duplex copying machine.

11 Claims, 10 Drawing Figures

TRANSFER MEDIUM SEPARATING DEVICE

BACKGROUND OF THE INVENTION

1. Field of the Invention

This invention relates to a transfer medium separating device for separating a transfer medium bearing thereon a toner image from a carrier member with which the transfer medium is in contact. More in particular, the present invention is concerned with a copy paper separating device in an electrophotographic copying machine for separating a copy paper from the surface of a photosensitive member.

2. Description of the Prior Art

In a transfer type electrophotographic copying machine, a photosensitive member, usually provided on the peripheral surface of the drum which is driven to rotate at constant speed, is first uniformly charged in a predetermined polarity by a corona charger. Then, a light image is exposed onto the thus charged surface of the photosensitive member thereby selectively removing the charges to form an electrostatic latent image by the remaining charges. Toner particles charged in the polarity opposite to that of the electrostatic latent image is applied to form a visible toner image. Next, a transfer medium such as a copy paper is brought into contact with the surface of the photosensitive member bearing thereon the toner image.

At this transferring station, a corona charger is usually used to apply charges of the polarity opposite to that of the toner image onto the backside of the copy paper so that the toner image may be electrostatically attracted to the front side of the copy paper. Thereafter, the copy paper, which is now in contact with the surface of the photosensitive member at least partly, is separated from the surface of the photosensitive member and then transported to a fixing station where the transferred toner image is permanently fixed to the copy paper by fusing. On the other hand, the photosensitive member is then subjected to a cleaning operation to remove any residual toner particles, and thereafter the photosensitive member is prepared for the next cycle of copying operation as described above.

This type of electrophotographic copying machine has become very popular and is widely used partly because of its ability to use a plain copy paper. Among many factors judging the performance of this type of copying machines, the transferring efficiency, i.e., ability to transfer the toner image from the photosensitive member to the copy paper, is the one which cannot be neglected at all. In order to obtain high transferring efficiencies, it is common practice to bring the copy paper in intimate contact with the photosensitive member. This then leads to a problem of separating the copy paper from the photosensitive member since they are strongly attracted each other.

One conventional and common approach was to use a separating pawl in combination with a charge neutralizer which is comprised essentially of a corona charger. That is, in accordance with this prior art technique, after the application of the transferring charges, the copy paper is electrostatically neutralized and the leading edge of the copy paper is brought into engagement with the pawl as the photosensitive drum rotates thereby the copy paper is mechanically separated from the photosensitive member gradually from its leading edge. However, there are numerous disadvantages in this prior art technique.

One of the disadvantages of the separating pawl approach is the difficulty for appropriate neutralization of the copy paper. For example, if the neutralization is insufficient, the copy paper strongly adheres to the photosensitive member, which, in turn, could cause problems such as tearing of the copy paper during the separating operation. On the other hand, if an excessive neutralization is carried out, the electric field for attracting the toner particles to the copy paper becomes weaker, which, in turn, could bring about lowering of the transferring efficiency as well as the image density. Another disadvantage stems from the fact that the pawl is provided to be always in contact with the surface of the photosensitive member. This structure allows to easily form scars on the photosensitive surface, for example, when a foreign matter such as debris gets sandwiched between the pawl and the surface. This is especially true for a photosensitive member comprised of organic materials.

Another proposed approach was to place a conductive member in the neighborhood of the copy paper which has been subjected to the transfer operation. In this case, an electrostatic attractive force is induced between the copy paper and the conductive member so that the copy paper may be removed from the photosensitive member. However, no practically applicable structure has yet been proposed.

SUMMARY OF THE INVENTION

The disadvantages of the prior art are overcome with the present invention and an improved device for separating a transfer medium from a carrier member such as a photosensitive member without lowering the transfer efficiency is provided.

The advantages of the present invention are attained by providing a conductive carrier member, a part of which is located in the proximity of the surface of the photosensitive member, and by applying a variable voltage to the conductive carrier member under control. Preferably, the conductive carrier member is in the form of an endless belt extended between a pair of pulleys. The potential of the conductive belt is controlled such that it is kept nearly at zero voltage in the first part of the separating operation so that the leading part of the copy paper is attracted toward the belt because of the attractive force therebetween. Then, in the second part of the separating operation, the potential of the belt is increased to a predetermined value of the polarity opposite to that of the toner image in order to securely retain the toner particles on the surface of the transfer medium.

The present invention is characterized by changing the potential of the conductive carrier member in two steps in order to insure an excellent separation with high toner transfer efficiencies. The timing to change potentials is important in the present invention. In one form, the potential of the conductive carrier member is changed after elapsing a predetermined period of time from the time when the leading edge of the transfer medium has passed a reference point. Alternatively, a sensor may be provided to detect the position of a transfer medium and the potential of the conductive carrier member is changed in response to a signal from the sensor. Still alternatively, the potential of the conductive carrier member may be changed by detecting the induced voltage of the conductive carrier member, which occurs when the charged transfer medium approches. Moreover, the transfer charger may be advantageously employed to change the potential of the conductive carrier member.

Preferably, timing adjusting means is provided to adjust the timing of changing the first separating step to the second separating step in accordance with the operating conditions such as copy paper properties, ambient conditions like temperature and moisture, magnification ratio, etc. Such adjusting means may comprise an input circuit and a central processing unit (CPU) whereby the input circuit supplies a signal containing some extra factors to be taken into account in the separating operation to the CPU. The CPU then supplies a timing adjusting signal to the timing control circuit. In this case, use may be made of the CPU which has already been provided in a copying machine, if any.

Alternatively, timing adjusting means may be formed in the form of a time constant adjusting circuit which adjusts the time constant of a timer of the timing control circuit in response to a signal containing the information of extra factors to be taken into account for the proper separating operation. Preferably, such a time constant adjusting circuit includes a variable resistor which is connected to the time constant circuit of a timer of the timing control circuit.

Where the present invention is applied to a duplex copying machine which makes copies on both sides of a copy paper, it is preferable to apply differing potentials to the belt between the first and second side reproductions. The lowered potential should be applied for the second side reproduction since the resistivity of the copy paper has increased by going through the first side reproduction process.

Therefore, it is an object of the present invention to provide an improved transfer medium separating device.

Another object of the present invention is to provide a transfer medium separating device which insures a stable separation with high toner transfer efficiencies.

A further object of the present invention is to provide a transfer medium separating device for use in a transfer type electrophotographic copying machine, whereby the surface of the photosensitive member is prevented from receiving scars from the separating device.

A still further object of the present invention is to provide a transfer medium separating device which can carry out an excellent separation irrespective of the kind of a transfer medium and the ambient conditions such as temperature and moisture.

A still further object of the present invention is to provide a transfer medium separating device which comprises timing adjusting means for adjusting the timing of changing the first separating step to the second separating step in accordance with the operating conditions in order to insure an excellent separating performance at all times.

A still further object of the present invention is to provide a transfer medium separating device which may be advantageously applied to a duplex copying machine which makes copies on both sides of a copy paper.

Other objects, advantages and novel features of the present invention will become apparent from the following detailed description of the invention when considered in conjunction with the accompanying drawings.

DESCRIPTION OF THE PREFERRED EMBODIMENTS

Figure 1:
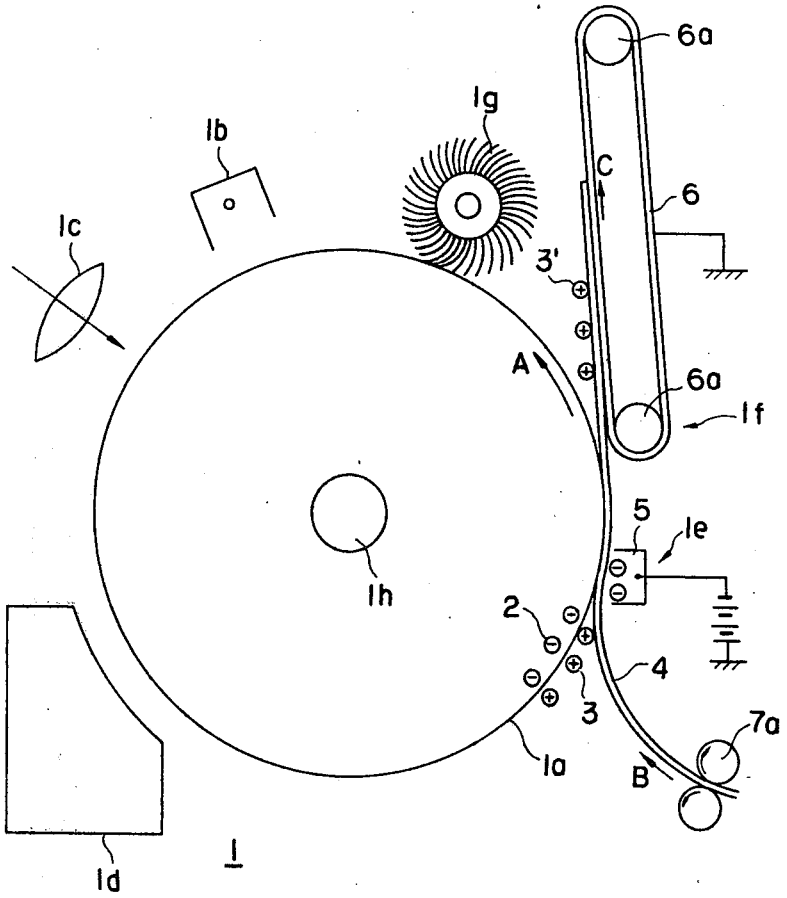
FIG. 1 is a schematic illustration of a typical transfer type electrophotographic copying machine useful for explaining the principle of the present invention.

Referring now to FIG. 1 which schematically shows the structure of a transfer type electrophotographic copying machine 1, a photosensitive drum 1*a* is rotatably journaled to a machine housing (not shown) and driven to rotate in the direction indicated by the arrow A at constant speed. As the drum 1*a* rotates, the surface of the drum 1*a*, which is sometimes referred to as a photosensitive surface, is uniformly charged by a corona charger 1*b* and then receives a light image through an image exposure system 1*c* thereby selectively dissipating the charges applied by the charger 1*b* to form an electrostatic latent image 2 on the drum surface. Then, the electrostatic latent image 2 is developed by a developing device 1*d* to form a visible toner image 3. In this example, since the electrostatic latent image 2 is formed by negative charges, the toner particles which form the toner image 3 possess positive charges.

When the toner image 3 is brought into a transfer station 1*e*, it is brought into contact with the front surface of a copy paper 4 which travels in the direction indicated by the arrow B in synchronism with the rotation of the drum 1*a*. In the transfer station 1*e* is provided a transfer corona charger 5 which applies negative charges to the rear surface of the copy paper 4 thereby attracting and transferring the toner image 3 onto the front surface of the copy paper 4. The copy paper 4 is usually brought into close contact with the photosensitive surface of the drum 1*a* to obtain a high transferring efficiency, for example, by means of rollers.

In the downstream of the transfer station 1*e* is provided a separating station 1*f* which includes a conductive endless belt 6 extended between a pair of pulleys 6*a* to travel in the direction indicated by the arrow c. A part of the belt 6, i.e., palley 6*a* side in the example shown in FIG. 1, is placed in the proximity of the photosensitive surface of the drum 1*a*. Accordingly, when the copy paper 4 having the transferring negative charges on the rear surface thereof as applied by the charger 5 comes into the separating station 1*e*, mirror charges of the positive polarity will be induced in that portion of the belt 6 which is opposed to the copy paper 4. As a result, the copy paper 4 having the transferred toner image 3' on its front surface is separated from the surface of the drum 1*a* and attracted to the belt 6 because of an electrostatic attractive force induced between the copy paper 4 and the belt 6. On the other hand, the photosensitive drum 1*a*, after separation of the copy paper 4, is brought to a cleaning station 1*g* where residual toner particles are removed, thereby preparing the drum 1*a* for the next cycle of copying operation.

Returning to the separating station 1*f*, the potential of the belt 6 plays an important role in the separating operation. If the belt is grounded as shown in FIG. 1, the transferring negative charges applied to the rear surface of the copy paper 4 will escape at least partly to the earth as soon as the copy paper 4 has been attracted to the belt 6. In this arrangement, although an excellent separating performance can be attained, some of the charges of the transferred toner image 3' are transferred back to the photosensitive drum 1*e* because of the escape of the transferring charges, thereby lowering the net transferring efficiency. On the other hand, if the belt is floated, the belt will gradually increase its negative potential by acquiring the transferring charges from the rear surface of the copy paper 4. This arrangement helps keep the charges of the transferred toner image 3' on the front surface of the copy paper 4, but there is a problem in separating performance sice there is a tendency to increase electrostatic repulsion between the copy paper 4 and the belt 6. Therefore, there exist seemingly incompatible requirements at the separating station.

In a commonly assigned copending application entitled "TRANSFER MEDIUM SEPARATING DEVICE," there is disclosed an improved separating device which can satisfy both of the transferring and separating requirements. The description of that application is hereby incorporated by reference. However, the key idea will be explained hereinbelow as a basis of the present invention.

Figure 2:
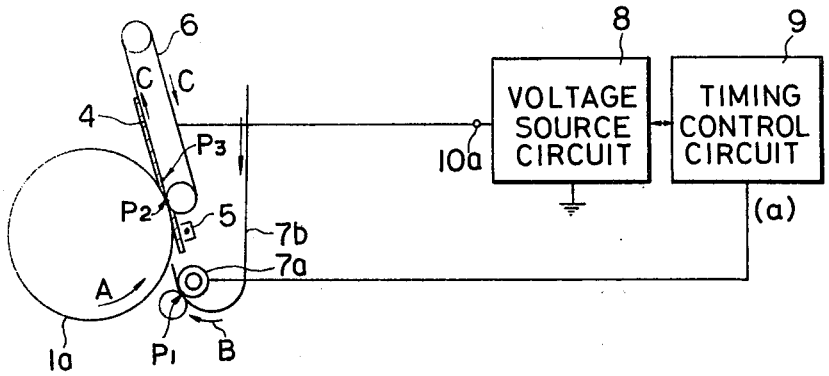
FIG. 2 is a schematic illustration partly shown in block diagram of one form of the transfer medium separating device.

In FIG. 2, there are shown only those elements which are necessary for the explanation of the first embodiment of the present invention, and, as practiced throughout this specification and the drawings, like numerals indicate like elements.

As shown, in the upstream of the transfer corona charger 5 is provided a register roller 7*a* in a copy paper travelling path 7*b*. The register roller 7*a* is normally held stationary to block the advancement of the copy paper 4 toward the transfer station. When a register signal (wave form (a) in FIG. 4) is applied, the roller 7*a* starts to rotate to advance the copy paper 4 in the direction indicated by the arrow B in association with the rotation of the drum 1*a*. It is to be noted that a voltage source circuit 8 is connected to the belt 6 and a timing control circuit 9 is provided as connected between the circuit 8 and the register roller 7*a*. With such a structure, the potential of the belt 6 may be controlled in association with the operation of the register roller 7*a* as will be fully described hereinbelow.

Figure 3:
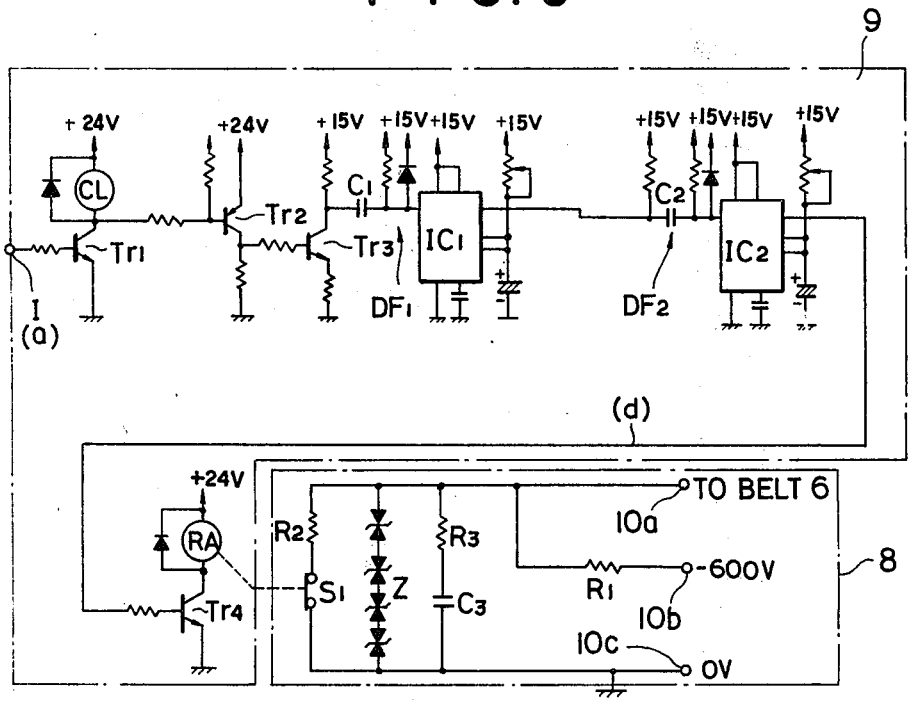
FIG. 3 is a circuit diagram showing details of the blocks shown in FIG. 2.
Figure 4:
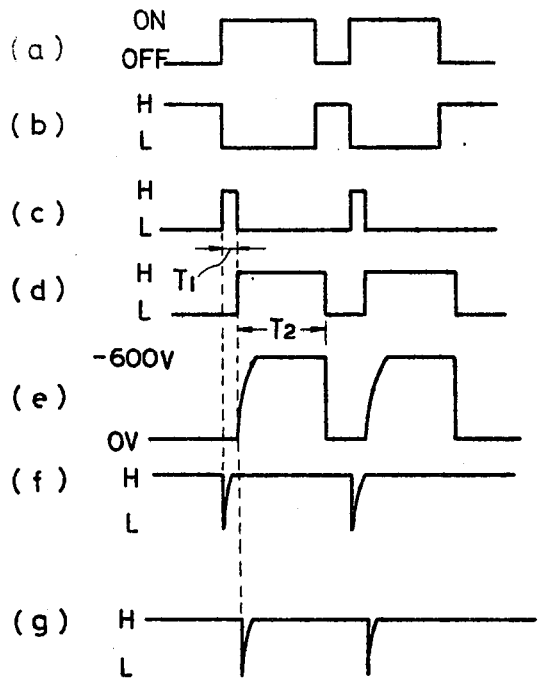
FIG. 4 is a timing chart showing several waveforms at appropriate points in the circuit of FIG. 3.

FIG. 3 shows one example of the detailed structure of the circuits 8 and 9 shown in FIG. 2. When the register signal (a) shown in FIG. 4 is supplied to an input terminal I of the timing control circuit 9, the transistor Tr1 is turned on thereby coupling the electromagnetic clutch CL to start the rotation of the register roller 7*a*. At the same time, transistors Tr2 and Tr3 are turned on so that the collector of the transistor Tr3 changes its state from a high level to a low level as shown by the waveform (b) in FIG. 4. This change in state is applied to a first differentiating circuit DF1 including the capacitor C1, so that the trigger pulse signal (f) shown in FIG. 4 is supplied to the first timer IC1. When triggered, the first timer IC1 maintains its output at high level for a time period of T1 as shown by the waveform (c) of FIG. 4.

The output from the timer IC1 is supplied to a second differentiating circuit DF2 including the capacitor C2. At the falling end of the signal (c), the second differentiating circuit DF2 supplies as its output the trigger signal (g) which is supplied as an input to the second timer IC2. As shown by the waveform (d) of FIG. 4, the second timer IC2 supplies a high level output to the transistor Tr4 for a time period of T2 when triggered by the signal (g). While the transistor is on, the relay RA is kept energized. The relay RA is operatively associated with the normally closed switch S1 of the voltage source circuit 8.

The voltage source circuit 8 has three terminals: output terminal 10*a* connected to the conductive belt 6, high voltage terminal 10*b* connected to a constant voltage source (not shown) of, for example −600 V and ground terminal 10*c* connected to the ground. The terminals 10*a* and 10*c* are connected each other through the registor R2 and the switch S1; moreover, the terminal 10*a* is connected to the high voltage terminal 10*b* via the resistor R1. Furthermore, between the terminals 10*a* and 10*c* are connected the constant voltage device Z and a series circuit comprised of the resistor R3 and the capacitor C3.

In operation, as long as the relay RA is not energized, the switch S1 keeps closed so that the potential of the terminal 10*a* and then the belt 6 is nearly at zero level. On the other hand, if the relay RA is energized to turn the switch S1 off, the capacitor C3 is gradually charged by the high voltage terminal 10*b* through the resistors R1 and R3 at a rate governed by the time constant determined by the resistors R1, R2 and the capacitor C3. Therefore, the potential of the output terminal 10*a* and thus the belt 6 increases up to −600 V as shown in FIG. 4, waveform (e).

Figure 5:
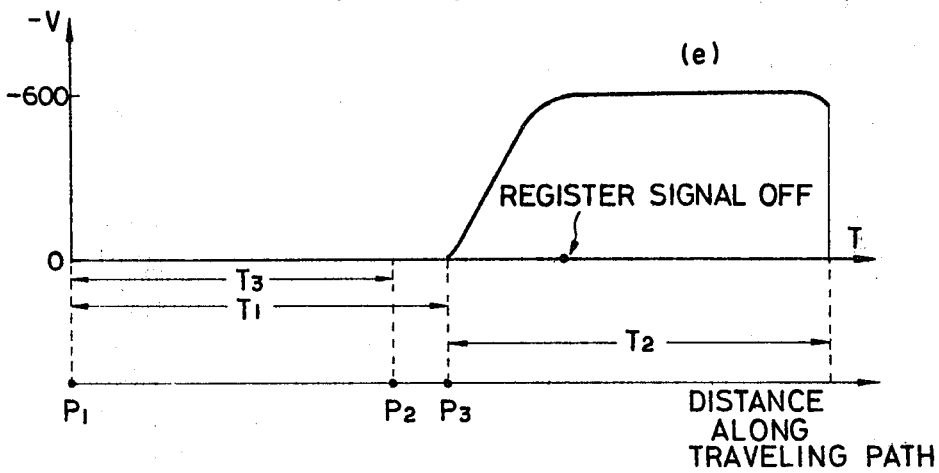
FIG. 5 is graph showing the variation of potential in time of the belt in the device shown in FIG. 2.

FIG. 5 shows the variation in time of the potential of the belt 6 in accordance with the embodiment described above. It also shows the variation of potential of the belt 6 in position of the copy paper 4 along its travelling path.

As shown, at time T=0, the register signal (a) is supplied to start the rotation of the register roller 7*a*, and, at the same time, the copy paper 4 starts its advancement with its leading edge at a point P1 defined at the contact point of the register roller 7*a*. At time T=T3, the leading edge of the copy paper 4 reaches a point P2 defined by the contact or closest point between the drum 1*a* and the belt 6; at this time, the belt 6 is still nearly at zero level since the switch S1 remains closed. As the copy paper 4 advances further and when its leading edge reaches a point P3 which corresponds to a predetermined time T1 set by the timer IC1, the relay RA becomes energized to turn the switch S1 off. Accordingly, the potential of the belt 6 starts to increase gradually in the negative polarity and finally reaches −600 volts. The timer IC2 starts its operation at T=T1 and continues its operation for a time period of T2. The time T2 is determined to be long enough to complete the separating operation. After elapsing the time T2, the belt 6 is returned to its original state as a preparation for the next cycle of operation.

As described above, when the leading edge of the copy paper 4 arrives at the point P2, the belt 6 is still maintained nearly at zero level so that the leading portion of the copy paper 4 is strongly attracted toward the belt 6 away from the drum 1*a*. This continues until the leading edge of the copy paper 4 has reached the point P3. Thus, for a time period during the leading edge travels from the point P2 to the point P3, some of the transferring charges on the rear surface of the copy paper 4 escape to the ground thereby allowing some of the toner particles on the front surface retransferred to the drum 1*a*, resulting in lowered transfer efficiencies at the leading portion of the copy paper 4. It should, however, be noted that this does not present any problem practically because the leading portion of the copy paper 4 where the retransfer occurs may be located in the margin of the copy paper 4.

The belt 6 starts to increase its potential gradually in the negative polarity when the time period T1 has elapsed so that the electrostatic attraction decreases with recovering an excellent transfer performance. Even if the attractive force is weakened due to the increased negative potential of the belt 6, since the copy paper 4 has already been brought into contact with the belt 6, it moves away from the drum 1*a* and stays in contact with the belt 6. Thus, a decrease in attractive force at this time would not cause any problem in the separating function. On the contrary, setting the belt 6 in the negative polarity helps keep the positive toner particles on the front surface of the copy paper 4, leading to a high transfer efficiency. The copy paper now advances in the direction indicated by the arrow C.

The capacitor C3 and the resistors R1 and R3 provided in the circuit 8 can assure the gradual increase of the potential of the belt 6 thereby a sharp change can be prevented from appearing in the leading portion of the copy paper 4. It should further be noted that although the relationship between the time periods T1 and T3 has been selected as $T1>T3$ in the above example, the other possibilities, i.e., $T1=T3$ and $T1<T3$, are equally applicable to the present invention. Selection should be made in consideration of the rising characteristics of the potential of the belt 6.

As described above, if the separating operation is carried out in two steps, i.e., the first step of maintaining the conductive belt 6 nearly at zero level and the second step of increasing the potential of the belt 6 to a predetermined value of the polarity opposite to that of the toner image on the front surface of the copy paper 4, there is formed a white belt area in the leading portion of the copy paper 4 since the charges on the front surface in this portion of the copy paper 4 are retransferred back to the photosensitive drum 1*a* during the first step of separating operation. The present invention proposes to make this white belt area practically as small as possible. That is, in accordance with the present invention, the timing of changing the first step to the second step is adjusted in consideration of the operating conditions such as the properties of a copy paper, ambient conditions and magnification changes in order to make the white belt area as small as possible.

Figure 6:
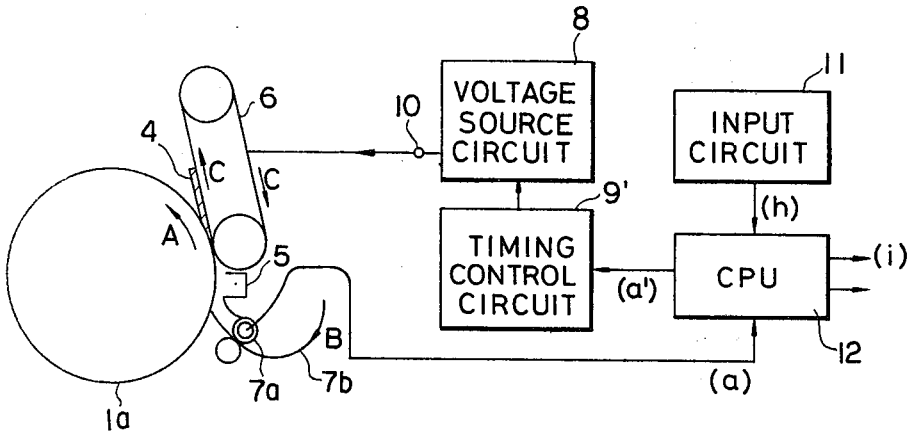
FIG. 6 is a schematic illustration partly in block diagram showing an embodiment of the present device provided with a timing adjusting function.

FIG. 6 shows one embodiment of the present invention. The register signal (a) is supplied to a central processing unit (CPU) 12 which is also connected to receive signals (h) from an input circuit 11. The signals (h) supplied from the input circuit 11 are signals which contain information such as properties of a copy paper to be used, temperature, moisture, magnification ratio, etc. The CPU 12 is connected to supply a signal (a') to the timing control circuit 9' which is, in turn, connected to the voltage source circuit 8. It is to be noted that the CPU 12 also handles other control functions associated with the copying operation and therefore it supplies various other control signals (i) to appropriate components of a copying machine.

Figure 7:
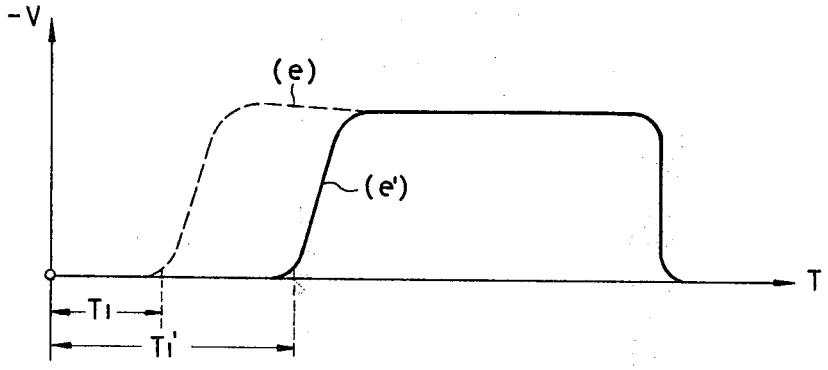
FIG. 7 is a graph which is useful for understanding the operation of the device shown in FIG. 6.

In response to the signal (h) supplied from the input circuit 11, the CPU 12 determines an optimum time T1 and supplies it to the timing control circuit 9'. For example, if the signal (h) supplied to the CPU 12 is of the nature to indicate difficulty in separating operation, then the CPU 12 supplies a signal (a') of a longer time T1' as shown in FIG. 7. In this instance, the belt 6 is kept at nearly zero level for a longer period of time to obtain a stronger electrostatic attraction, thereby carrying out a proper separating operation. It is, however, true that the longer the period of the first separating step, the wider the white belt area of the copy paper 4. In other words, the width of the white belt area depends upon the length of the time period of the first separating step. Practically speaking, the width of the white belt area is about 3 mm at maximum and therefore it is well within the margin of the copy paper 4 and does not present a severe problem.

Figure 8:
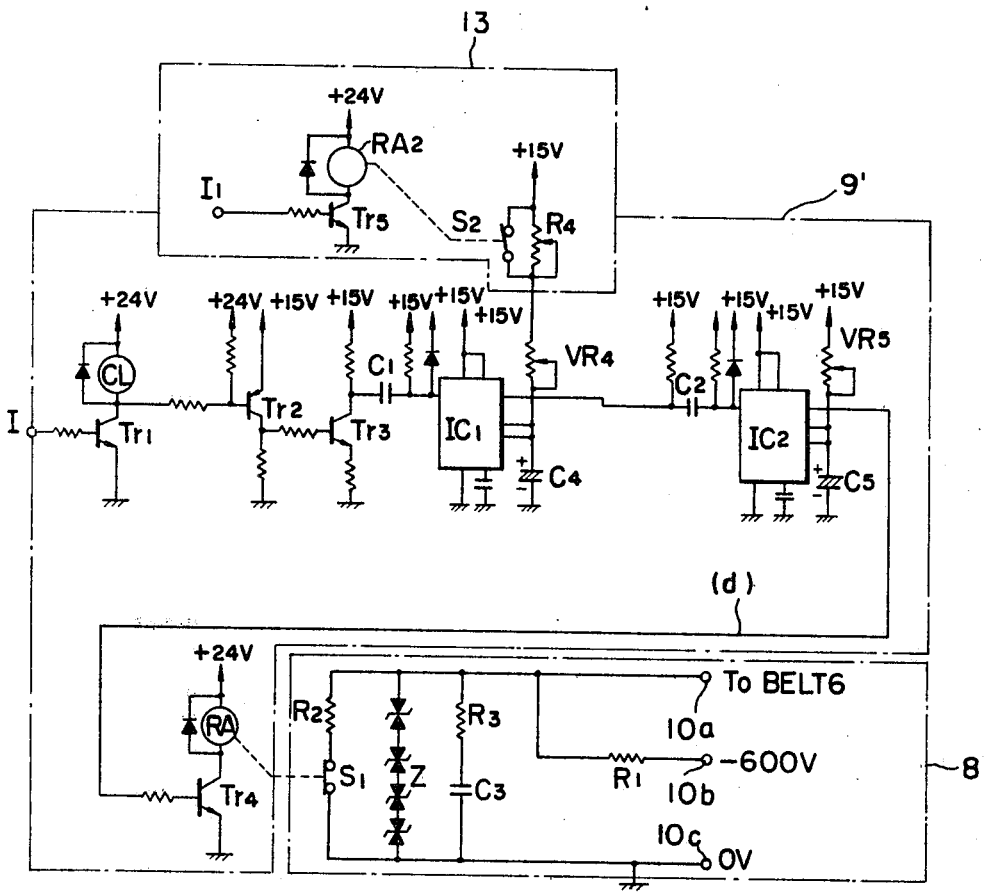
FIG. 8 is a circuit diagram showing another embodiment of the present device provided with a timing adjusting function.

FIG. 8 shows another embodiment of the present invention. As shown, this embodiment is characterized by the addition of a timing adjusting circuit 13 to the timing control circuit 9'. The timing adjusting circuit 13 includes a variable resistor R4 which is connected to the time constant circuit of the timer IC1, which, in turn, is comprised of the resistor VR4 and the capacitor C4. The time T4 is determined by VR4 and C4. A normally closed switch S2 is connected in parallel with the resistor R4 and the switch S2 is operatively associated with a relay RA2 which is connected to the collector of a transistor Tr5. A terminal I1 is connected to the base of the transistor Tr5. Thus, when a timing adjusting signal is applied to the terminal I1, the transistor Tr5 is turned on and then the relay RA2 becomes energized.

For example, if there is a factor which indicates difficulty in separating operation, a timing adjusting signal is applied to the terminal I1. Thus, the switch S2 is turned off due to energization of the relay RA2 and this effectively adds the resistor R4 to the time constant circuit of the timer IC1. As a result, the time period of the first separating step is increased from T1 to T1' to produce a stronger attractive force.

Figure 9:
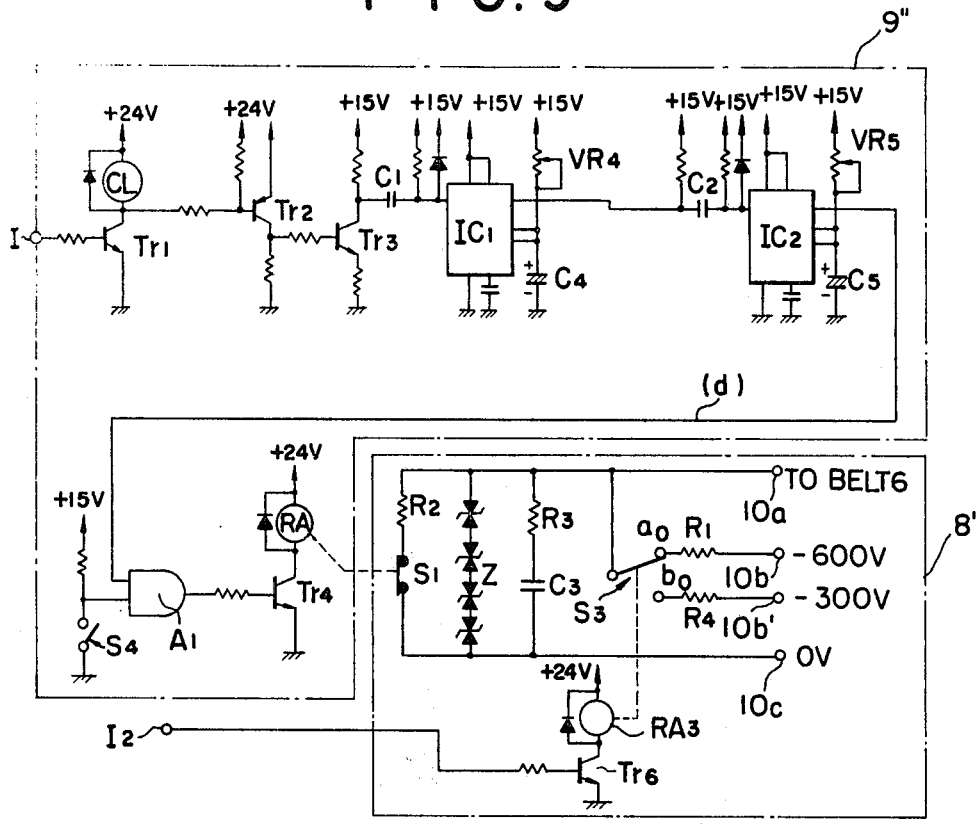
FIG. 9 is a circuit diagram showing one embodiment of the present device when applied to a duplex copying machine.

Referring now to FIG. 9, there is shown a further embodiment of the present invention when the present invention is applied to a duplex copying machine which makes copies on both sides of a copy paper. When a copy is to be made on both sides of a copy paper, the condition of the copy paper is not the same between the time to make a copy on one side of the copy paper and the time to make a copy on the other side. That is, when a copy is to be made on the reverse side after the front side, since the copy paper has already gone through a copying process once, the copy paper has lower moisture contents and it has toner and silicon oil on its surface so that the volume resistivity of the copy paper is very high. It has been found that, prior to the first side copy, the volume resistivity of the copy paper is around $10^{11}$ Ω.cm; whereas, prior to the second side copy, the resistivity sometimes shows the value of $10^{15}$ Ω.cm.

Therefore, if the same transfer charger is used, the copy paper can hold more charges for the second side reproduction as compared with the first side reproduction. This indicates that there is produced a stronger repulsive force between the copy paper and the conductive belt since they have the charges of the same polarity except the leading portion of the copy paper thereby making the separating operation unstable. Therefore, in the case of a duplex reproduction, the potential applied to the conductive belt should be made smaller for the second side reproduction since the copy paper holds more charges at this time.

Referring now to FIG. 9 which shows a circuit diagram embodying the present invention, it generally comprises a voltage source circuit 8' and a timing control circuit 9''. It should be noted that the voltage source circuit 8' has two high voltage terminals **10*b* and 10*b'* which are selectively connected to the terminal 10*a* via a switch S3. The first high voltage terminal 10*b* is connected to a constant high voltage supply of −600 volts and the terminal 10*b* is connected to the normally closed contact point $a_o$ through a resistor R1. On the other hand, the second high voltage terminal 10*b'* is connected to another constant voltage supply of −300 volts and the terminal 10*b'* is connected to the normally open contact point $b_o$ through a resistor R4**.

The switch S3 is operatively associated with a relay RA3 which is connected to the collector of a transistor Tr6, the base of which is connected to an input terminal I2. Between the terminals **10*a* and 10*c* are connected a resistor R2 and a normally closed switch S1 in series. The switch S1 is operatively associated with the relay RA which is connected to the collector of the transistor Tr4. The base of the transistor Tr4 is connected to the output of an AND gate A1, one input of which is connected to the output of the second timer IC2 with the other input connected to the ground via a white paper mode switch S4. When the switch S4** is closed, the relay RA is held inoperative.

In operation, at the time of the first side reproduction, no signal is supplied to the input terminal I2 so that the transistor Tr6 is held off. Therefore, the relay RA3 is not energized and the switch S3 is kept in contact with the normally closed contact point $a_o$. Thus, the terminal **10*b* is connected to the terminal 10*a* via the resistor R1 and the switch S3. Under the circumstances, when the signal (d) is supplied to energize the relay RA, the switch S1 is turned off thereby the potential of the belt 6** gradually increases up to −600 volts as described before.

At the time of the second side reproduction, a second side copy signal is supplied to the input terminal I2 so that the transistor Tr6 is turned on to energize the relay RA3 thereby the switch S3 is switched to be in contact with the normally open contact point $b_o$. As a result, the terminal **10*b'* is now connected to the terminal 10*a* via the resistor R4 and the switch S3. Therefore, the potential of the belt 6** now gradually increases toward −300 volts.

Figure 10:
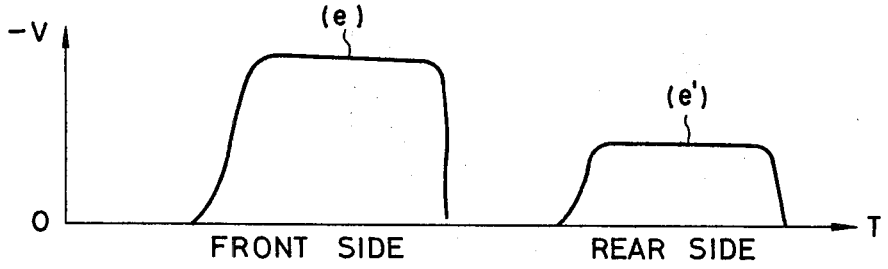
FIG. 10 is a graph which is useful for understanding the operation of the device shown in FIG. 9.

FIG. 10 is a graph showing the potential variation in time of the belt 6 where a duplex reproduction is carried out. That is, when the first side reproduction is carried out, the potential of the belt 6 rises up to −600 volts as shown by the line (e); whereas, when the second side reproduction is carried out, the potential rises only up to −300 volts as shown by the line (e'). The lower potential is applied to the belt 6 for the second side reproduction in order to take into account the fact that the copy paper represents a higher resistivity and therefore can hold a larger amount of charges as explained before.

If it is desired to leave the second side as a white surface, the white paper mode switch S4 is turned on upon completion of the first side reproduction. Once the switch S4 is turned on, the relay RA is held inoperative irrespective of whether an output signal is supplied from the timer IC2 or not, and, therefore, the switch S1 remains closed to keep the potential of the terminal **10*a*** nearly at zero level. Accordingly, no image is transferred to the second side and the copy paper is properly separated from the photosensitive drum.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defiend by the appended claims.

What is claimed is:

1. A transfer medium separating device for separating a transfer medium from a first carrier means, bearing thereon a toner image, to which said transfer medium has been brought into contact to transfer the toner image onto said transfer medium from said first carrier means, comprising:

second carrier means of an electrically conductive material to which said transfer medium having thereon said toner image is to be gradually brought into contact due to electrostatic forces from its leading edge as separated from said first carrier means;

potential application means for selectively applying at least a first level potential and a second level potential which is different from said first level potential to said second carrier means;

timing control means for controlling the timing of changing from said first level potential to said second level potential to be applied to said second carrier means such that said second carrier means is kept at said first level potential until the leading edge of said transfer medium has reached a predetermined reference point along its traveling path with respect to said second carrier means; and timing adjusting means connected to said timing control means for adjusting the timing of changing potentials by said timing control means and thus adjusting the location of said reference point in response to conditions of the separating operation.

2. The separating device of claim 1 wherein said timing adjusting means includes a central processing unit thereby information as to the conditions of the separating operation is fed to said central processing unit which, in turn, supplies a timing adjusting signal to said timing control means.

3. The separating device of claim 2 wherein said timing adjusting means further includes an input circuit connected to said central processing unit thereby the information as to the conditions of the separation operation can be fed by the operator through said input circuit.

4. The separting device of claim 1 wherein said timing control means includes at least one timer and a time constant circuit connected to said timer and said timing adjusting means includes time constant adjusting means connected to said time constant circuit of said timing control means.

5. The separating device of claim 4 wherein said time constant circuit includes a first resistor and a capacitor, and said time constant adjusting means includes a second resistor which is selectively connected to said first resistor thereby effectively changing the value of said time constant circuit.

6. A transfer medium separating device for separating a transfer medium from a first carrier means, bearing thereon a toner timage, to which said transfer medium has been brought into contact to transfer the toner image onto said transfer medium from said first carrier means, comprising:

second carrier means of an electrically conductive material to which said transfer medium having thereon said toner image is to be gradually brought into contact due to electrostatic forces from its leading edge as separated from said first carrier means;

potential application means for selectively applying potentials different in level to said second carrier means;

timing control means for controlling the timing of changing potentials to be applied to said second carrier means from the initial level to a selected level such that said second carrier means is kept at said initial level until the leading edge of said transfer medium has reached a predetermined reference point along its traveling path with respect to said second carrier means; and selecting means for selecting said selected level of potential to be applied to said second carrier means by said potential application means as changed from said initial level.

7. The separating device of claim 6 wherein said potential application means includes a plurality of voltage sources which are different in level and said selecting means selects one of said plurality of voltage sources to be connected to the output of said potential application means in response to a signal fed.

8. The separating device of claim 6 wherein said potential application means includes two voltage sources which are different in level and said selecting means first selects the higher voltage source and, in the next cycle, selects the remaining lower voltage source.

9. The separating device of claim 1 wherein said first carrier means includes a photosensitive member in the form of a drum to be used in an electrophotographic image forming process and said second carrier means includes an electrically conductive endless belt.

10. The separating device of claim 9 wherein said reference point is determined at the location in the downstream of the contact or closest point between said drum and said belt along the traveling path of said transfer medium.

11. The separating device of claim 10 wherein said first level potential is ground potential.

* * * * *